United States Patent [19]

Shibata

[11] 4,015,433

[45] Apr. 5, 1977

[54] METHOD FOR SETTLING ANCHORING DEVICE IN THE GROUND

[76] Inventor: Mituo Shibata, No. 15-3, Oshima 2-Chome, Kawasaki, Kanagawa, Japan

[22] Filed: Nov. 19, 1975

[21] Appl. No.: 633,193

Related U.S. Application Data

[60] Division of Ser. No. 537, Dec. 30, 1974, Pat. No. 3,935,912, which is a continuation of Ser. No. 350,841, April 13, 1973, abandoned.

[52] U.S. Cl. ..... 61/53.6; 61/53.68; 52/160; 175/274; 175/253

[51] Int. Cl.[2] ..... E02D 5/44; E02D 5/54

[58] Field of Search ..... 61/53.68, 53.6, 39, 61/45 B; 52/160, 162, 164, 165, 163; 175/253, 260, 262, 265, 264, 277, 274

[56] References Cited

UNITED STATES PATENTS 1,695,523 12/1928 Bilhorn ..... 61/53.68 X

FOREIGN PATENTS OR APPLICATIONS 256,150 8/1926 United Kingdom ..... 61/53.6

*Primary Examiner*—Jacob Shapiro
*Attorney, Agent, or Firm*—Nilsson, Robbins, Dalgarn & Berliner

[57] ABSTRACT

The present invention relates to an anchoring device which rigidly supports many kinds of standing objects in public works or in the construction industry and provides resistance to pulling loads exerted on the device, and also to a method for settling the device in the bottom of a deep shaft bored into the ground.

7 Claims, 13 Drawing Figures

METHOD FOR SETTLING ANCHORING DEVICE IN THE GROUND

This is a division of application Ser. No. 537,159, filed Dec. 30, 1974, Pat. No. 3,935,912, which in turn is a continuation of application Ser. No. 350,841, filed Apr. 13, 1973, abandoned.

FIELD OF THE INVENTION

The field of art to which the invention pertains includes the field of anchoring devices.

BACKGROUND AND SUMMARY OF THE INVENTION

It is necessary that an anchoring device settled in the ground be capable of bearing a pulling load as large as possible when it is adapted for supporting a standing object.

Therefore, it is an object of the present invention to provide a novel anchoring device capable of exhibiting an increased resistance to pulling loads exerted on the device on the surface of the ground, and a method for rigidly settling the device in the bottom of a deep shaft in the ground in a manner such that the settled device cannot be pulled out of the shaft.

It is another object of the present invention to provide a novel anchoring device provided with means for ascertaining that the device is appropriately settled in the ground.

It is still another object of the present invention to provide an anchoring device provided with means for bearing compression exerted on the device, and a method for settling the device in the ground so that the anchoring device can bear the compression applied from above the ground.

In accordance with one of the features of the present invention, an anchoring device comprises a vertical tubular rod; a plurality of support arms, one end of each support arm being connected with a lower part of the tubular rod so that said support arm is turnable about the connected end in a vertical plane including an axis of said tubular rod; a plurality of fluke blades one of which is mounted on each support arm, to constitute cutting arms; means for urging said cutting arms to outwardly turn about said connected ends of said support arms from a folded state in which said cutting arms are brought together about said tubular rods; means for stationarily supporting one end of said urging means on a part of said tubular rod; holding means for releasably restraining said cutting arms in the folded state, said holding means having a line means to release the restraint of said cutting arms above the ground surface, and; means for limiting the turn of said cutting arms to a selected amount of angles from said folded state.

Further, in accordance with another feature of the present invention, a method for settling the anchoring device of the present invention into a shaft bored in the ground comprises at least the processes of:

i. folding the cutting arms by means of the holding means having the release line;

ii. pulling said release line of said holding means when said anchoring device reaches a bottom of said shaft;

iii. providing rotational motion to said cutting arms lying against the inner wall of said shaft from above the ground by means of an ordinary boring machine for a predetermined time, and;

iv. lifting said anchoring device while said cutting arms rotate at a preselected height so that a cavity engageable with said cutting arms of said anchoring device is formed in said bottom of said shaft.

The other features, and advantages of the present invention will be apparent from the ensuing description with reference to the accompanying drawings.

DETAILED DESCRIPTION

Figure 1:
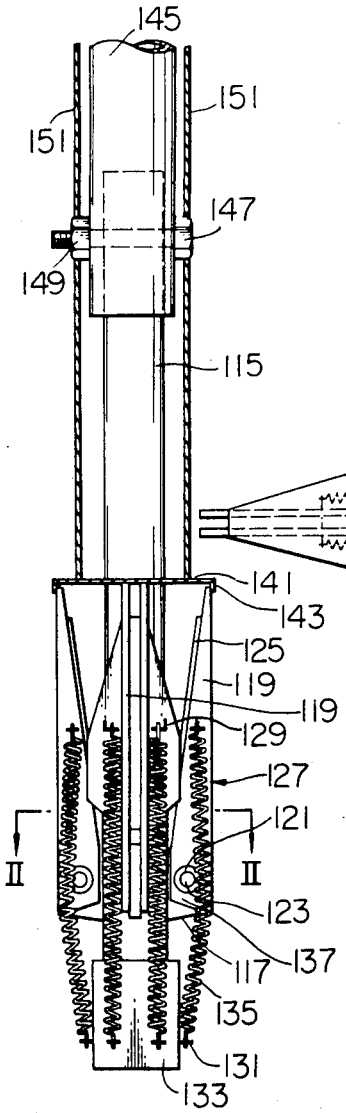
FIGS. 1 and 2 are respectively, a front view of an anchoring device with a part cut out, and a plan view along line II—II of FIG. 1, according to one embodiment of the present invention.
Figure 2:
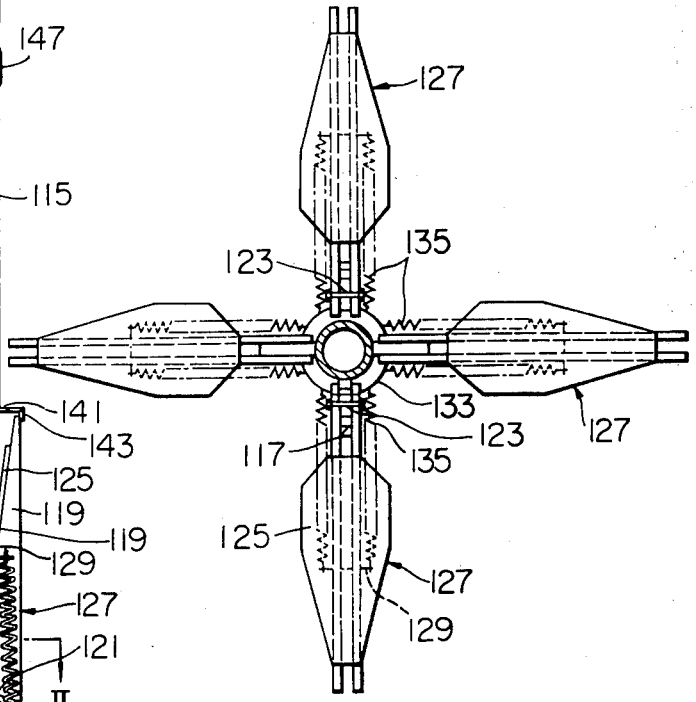

Referring to FIG. 1 and FIG. 2, a tubular rod 115 is provided with lugs 117 radially projecting from the outer surface of the lower part of the tubular rod 115. On each of the lugs 117 one end of support arm 119 is mounted so that the support arm 119 may be turned about a pivot 123. A fluke blade 125 is supported on the upper surface of each support arm 119 and thus, four equiangularly arranged cutting arms 127 are provided in this embodiment as shown in FIG. 2. At the back of each cutting arm 127, a spring pin 129 projects from the outermost portion of support arm 119. Also, spring pins 131 are provided on the outer surface of a bottom support 133, which is provided on the lowermost end of tubular rod 115. A spring 135 is connected with spring pin 129 at its one end and with spring pin 131 at the other end, so that spring 135 may always exert a force against each cutting arm 127 so as to urge cutting arm 127 to outwardly turn about pivot 123 from the closed state as shown in FIG. 1. The closed state of cutting arms 127 is held by a holding plate 141 against the force exerted by springs 135. The holding plate 141 is formed into a shallow cup having a circumferential wall 143 with which the front edge of each support arm 119 is engaged so as to maintain the closed state of cutting arms 127 as shown in FIG. 1. The engagement between holding plate 141 and the outer edges of cutting arms 127 is released by upwardly pulling lines 151 which are connected to holding plate 141 at their lowermost end.

An opened state of four cutting arms 127 is shown in FIG. 2. When cutting arms 127 are turned outwardly by the force of springs 135, inner ends 137 of support arms 119 will become engaged with the outer surface of tubular rod 115 and also with upper ends 139 of the bottom support 133. As a result, the turning motion of cutting arms 127 can be restricted to the amount of the preselected 75 degrees, in order to provide appropriate operation of fluke blades 125.

At the top of tubular rod 115, an additional tubular rod 145 is connected by means of a bolt 147 and a nut 149. This additional tubular rod 145 is employed for the purpose of extending the length of the anchoring device so that the anchoring device may be applicable to a deep shaft in the ground.

Figure 3A:
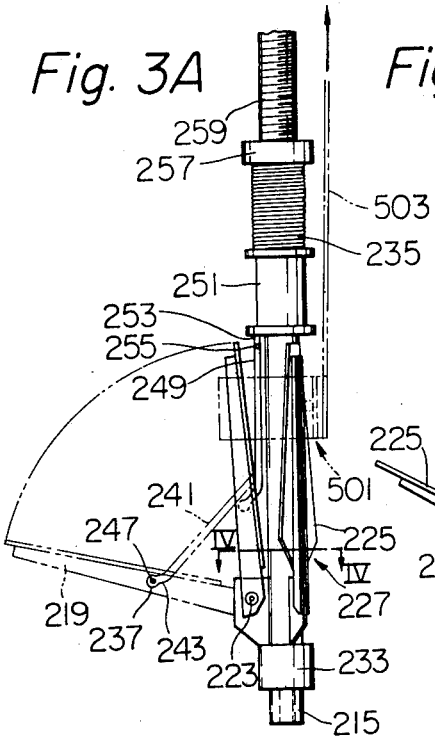
FIGS. 3A and 4 are respectively, a front view of an anchoring device with a part cut out, and a plan view along line IV—IV of FIG. 3, according to another embodiment of the present invention.
Figure 4:
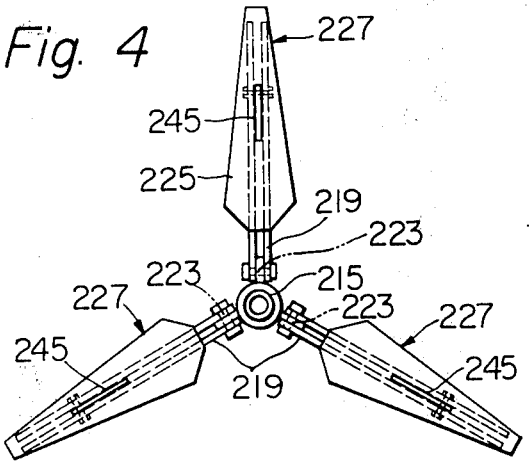

Referring now to FIGS. 3A and 4, another embodiment of the anchoring device according to the present invention is shown. In this embodiment, there are provided three equiangularly arranged cutting arms 227 having cross arms 241, the lower end 243 of which extend through slots 245 formed in fluke blades 225 and are connected with pivots 247 in bores 237 of support arms 219 so as to be pivotal about the pivots 247. The upper end 249 of each cross arm 241 is connected so as to be pivotal with a pivot 255 mounted in an extension 253 which is provided on the lower end face of an annular flange member 251. The annular flange member 251 is mounted so as to be slidable on the tubular rod 215. Above the annular flange member 251, a stationary flange 257 is fixed on the tubular rod 215, and between the flange 257 and the upper flange of annular flange member 251, a strong coil spring 235 is provided on tubular rod 215. In FIG. 3A, it is shown that spring 235 is compressed between stationary flange 257 and movable annular flange member 251. Therefore, the annular flange member 251 is pushed downwardly by the compressed spring 235. When the member 251 moves downwardly, the lower flange of the members 251 pushes down each cross arm 241 of cutting arms 227 which are in the closed state shown by the solid lines in FIG. 3A.

Figure 6:
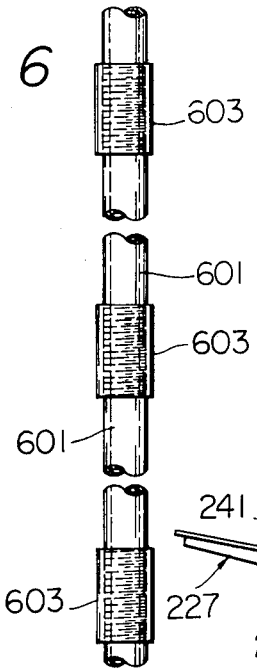
FIG. 6 is a partial front view of additional tubular rods adapted for use in extension of the length of the anchoring device shown in FIGS. 1 through 5A, and couplings connecting between the tubular rods.

Thus, cross arms 241 moves downwardly while pivoting about pivots 237 and 255 and, as a result, cutting arms 227 are opened to the state shown by dotted lines in FIG. 3A by turning about pivot 223 in the manner similar to the embodiment shown in FIGS. 1 and 2. The turning angle of each cutting arm 227 from the closed state to the opened state is preferably limited to 75 degrees similar to the embodiment of FIGS. 1 and 2. At the upper portion of tubular rod 215, a screw thread 259 is formed on the outer surface of tubular rod 215 so that additional tubular rod 601 shown in FIG. 6 may be connected to the anchoring device by forming a screw thread in the internal surface of the additional tubular rod 601. The additional tubular rod 601 may be assembled by several tubular rod pieces by employing coupling means, such as screw couplings 603 as shown in FIG. 6. Numeral 233 is a bottom support provided on the lower end part of the tubular rod 215.

Figure 3B:
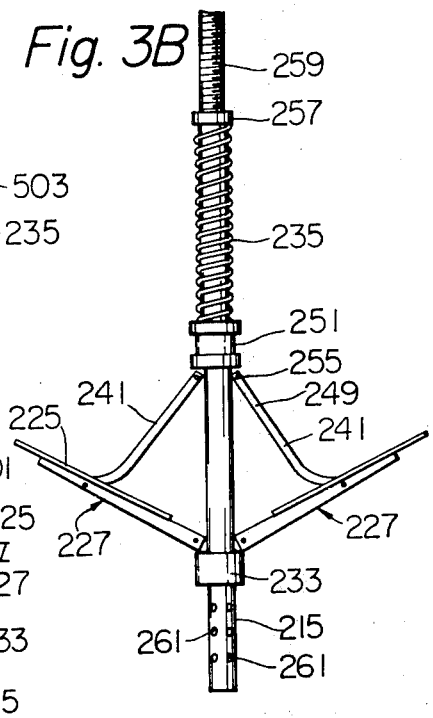
FIG. 3B is a front view of a modified anchoring device of FIGS. 3A and 4.

FIG. 3B shows a further modification of the embodiment of FIGS. 3A and 4 in which openings 261 are provided in the lower end surface of tubular rod 215 so as to be connected with the inner passage of the rod 215. The operation of these openings will be described later. The other elements of this modification are similar to the embodiment of FIGS. 3A and 4, and therefore, the elements are designated by the same reference numerals.

Referring again to FIG. 3A, it will be understood that in the closed state of cutting arms 227, they are bound with a holding band 501 as shown by dotted lines in FIG. 3A. The holding band 501 is provided with a pulling line 503, and when the pulling line 503 is pulled upwardly, the holding band 501 is released, and the cutting arms 227 are opened in the manner as explained before.

Figure 5:
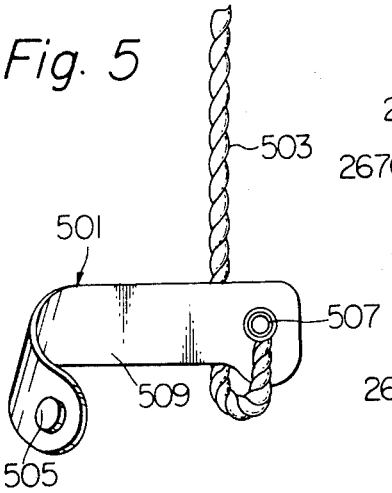
FIG. 5 is a perspective view of a holding band adapted for bundling the cutting arms of the anchoring devices shown in FIGS. 3A and 3B.

FIG. 5 shows a preferred embodiment of the holding band 501. The holding band 501 consists of a band strip 500, a fastening button 505 provided on the strip 509, a button hole 507 formed in the strip 509, and a pulling line 503. As shown in FIG. 5, one end of the pulling line 503 is fixed to the end of band strip 509 and pulling the other end of the pulling line 503 will cause releasing of the fastening between button 505 and button hole 507. Thus, when the anchoring device is thrown or inserted into a deep shaft in the ground so as to be settled in the bottom of the shaft, cutting arms 227 are preliminarily closed or folded, and are bound with holding band 501 on or above the ground so as to remain the closed state until the inserted anchoring device reaches to the bottom of the shaft.

The process of settling the anchoring device of the present invention in the ground will be explained referring to FIGS. 7 and 8.

When the anchoring device is to be settled in a position in the ground, a shaft is bored at the desired position by means of a boring machine 801 so that the diameter of the shaft will allow the free passage of the device in the closed state through the shaft. Also, the depth of the shaft is appropriately selected depending upon both the pulling load exerted on the device and the soil around the shaft. In order to insert the anchoring device into the bottom of the shaft, the length of the anchoring device is increased so as to correspond to the depth of the shaft by connecting the required additional tubular rods 601 to the anchoring device. It should be noted that the upper ends of the additional tubular rod 601 and the pulling line 503 must be brought above the surface of the ground through the opening of the shaft, when the anchoring device lays in the bottom of the shaft as shown in FIG. 7.

It will be seen from FIG. 7 that a later described ascertaining line 265 with a weight 269 is also brought out of the shaft. When the inserting process is completed, folded cutting arms 227 are released by pulling the line 503 from above the ground and, as a result, cutting arms 227 open due to the force of spring 235 as explained before, until they come into contact with the wall of the shaft. In this state, of course, cutting arms 227 will not completely open and, therefore, in order to rigidly fix the anchoring device in the shaft it is necessary to pull the device upwardly so that the open cutting arms 227 may catch in the inner wall of the bottom part of the shaft. However, with some kinds of soil in a shaft it may be difficult for the cutting arms 227 to catch in the wall. That is to say, the outer ends of the cutting arms 227 may slip on the surface of the wall and fail to completely catch in the soil of the wall. In order to overcome such failure, it is always necessary to completely open all cutting arms 227 over the above-mentioned 75 degrees. In accordance with one of the features of the present invention, the open cutting arms 227 of the anchoring device may be provided with rotational motion through rotation of the additional tubular rod 601 driven by the ordinary boring machine 801 as shown in FIG. 7. That is to say, the end of additional rod 601 extending above from the shaft, is connected to the boring head 801a of the boring machine so that the rod 601 may be rotated by the boring machine 801. In accordance with the rotation of the anchoring device, the edge of fluke blades 225 (refer to FIG. 4) will cut out the soil around the shaft wall. Thus cutting arms 227 increase their opening angle due to the force of the spring 235 while expanding the bottom of the shaft. The rotating time of the anchoring device required for completely opening the cutting arms 227, can be appropriately selected, since the characteristics of the soil within the shaft will have been examined during boring of the shaft.

In order to aid cutting arms 227 to cut the soil of the shaft wall, pressured water may be supplied from the top of the additional tubular rod 601. The pressured water introduced through the internal passageway of the rods 601 and 215, and jetting from the lowermost opening of the tubular rod 215 and from openings 261 of the rod 215, (refer to FIG. 3B), will cut out or soften the soil of the shaft wall due to its high pressure. Thus, since the cutting arms 227 are completely opened, the fluke blades 225 of the arms 227 catch in the wall of the shaft without failure. As a result, the anchoring device is fixed in the ground so that the device can support a standing object through engagement of the object with the top of the additional tubular rod 601 extending above the surface of the ground. The device can also resist pulling loads applied from above the ground.

In accordance with another feature of the present invention, while the anchoring device is rotated by the boring machine 801, the device is simultaneously given an upward movement via the vertical movement of the boring head 801a. As a result, a cavity 807 shown in FIG. 8 is formed in the lower part of the shaft. In this case, the soil cut out from the shaft wall is fed out of the cavity through the shaft to the surface of the ground with the water which has jetted from the openings of the rod 215, as shown by arrows in FIG. 8. Upon completion of forming of the cavity 807, the supply of pressured water into the shaft is stopped with the anchoring device continuing its rotation within the cavity 807. Subsequently, while the anchoring device is rotating, filling such as milk of cement containing calcium chloride, concrete, or cement mortar is filled into the cavity 807 and also up to the entrance of the shaft through the inner passageways of the tubular rods 601 and 215. Then, continuing the filling, appropriate aggregate is also thrown into the cavity 807.

Figure 10:
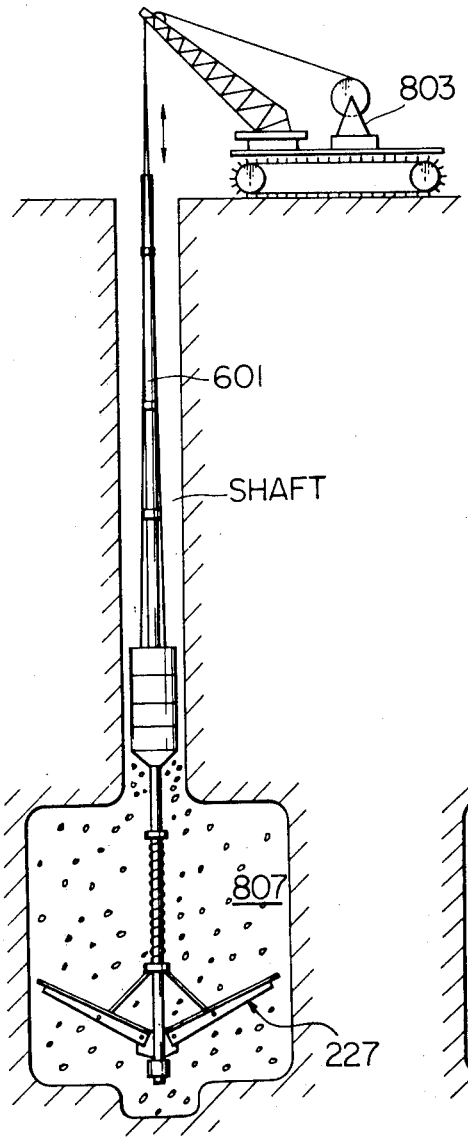
FIG. 10 is a digrammatical view with a part sectioned, illustrating a rigid settling operation of the anchoring device, according to the present invention.

Consequently, the filling and the aggregate will be mixed due to the rotation of the anchoring device. On the other hand, generation of the mixture will increase resistance to the rotating motion of the anchoring device and finally, it will become impossible to continue to rotate the device. When the anchoring device within the shaft reaches this state, it can be understood that the cutting arms of the anchoring device are completely encapsulated by the concrete within the cavity 807. Subsequently, the drive of the rotation of the anchoring device is stopped, and the boring machine 801 is displaced. Then, after further addition of an appropriate amount of aggregate into the shaft, a drop hammer 805 shown in FIG. 9 is located within the shaft. The drop hammer, as shown in FIG. 9, consists of: a hammering weight 813; a preselected number of unitary weights 815; connecting shafts 817 associated with the hammering weight 813 at their lowermost ends; hanging cables 821, the lower ends of which are associated with rings 819 provided on the tops of the connecting shafts 817, and the upper ends of which are associated with a winch 803 (refer to FIG. 10). Central bores 823 of the hammering weight 813 and the respective unitary weights 815 are provided for passing therethrough the additional tubular rods 601. The number of unitary weights 815 may be selected depending on the scales of cutting arms 227 and the length of the shaft in the ground. After location of the drop hammer 811, hammering action of the drop hammer 811 is repeated by means of the winch 803 in order to compact the filling and the aggregate within the shaft. Of course, it may be possible to repeat the addition of aggregate into the shaft, in order to reinforce rigidness of the settled anchoring device of the present invention. FIG. 10 shows the process during which compaction of the filling and the aggregate is carried out.

When the required compaction of the aggregate is obtained up to the entrance of the shaft, drop hammer 811 is removed and subsequently, the winch 803 is also displaced. Hence, the anchoring device which can no longer be taken out of the shaft, is prepared for supporting a standing object or for bearing pulling loads attached to the device on the surface of the ground. It will be easily understood that regardless of the soil around the shaft, rigid and reliable settlement of the anchoring device is achieved in order to bear large pulling loads attached to the device.

Figures 7, 8, 9:
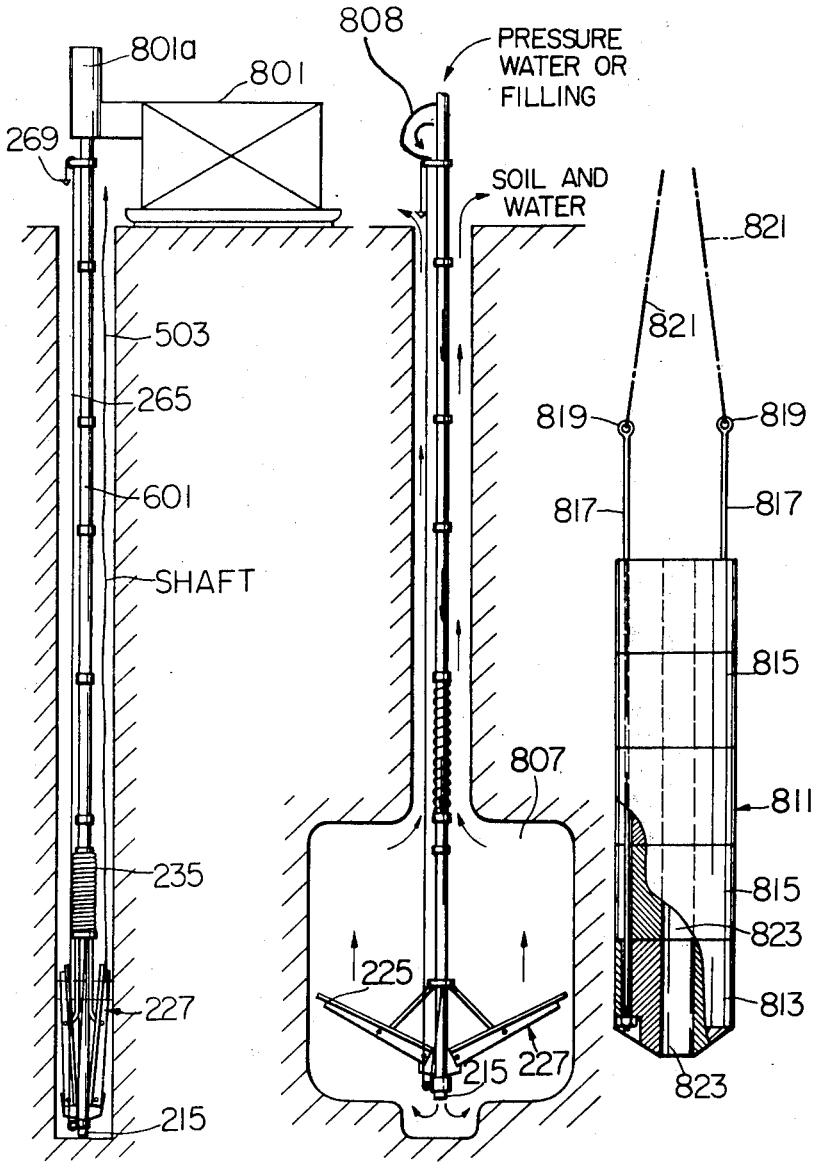
FIG. 7 is a diagrammatical view with a part sectioned, showing that the anchoring device is inserted into a shaft in the ground.
FIG. 8 is a diagrammatical view with a part sectioned, showing that the cutting arms of the anchoring device are completely opened while forming a cavity in the lower part of the shaft.
FIG. 9 is a front view, with a part sectioned, of a drop hammer used for settling the anchoring device of the present invention.

In FIGS. 9 and 10, a method for compacting the filling and the aggregate within the shaft by means of a drop hammer is explained. However, other methods, such as vibrating the anchoring device itself by means of an ordinary vertical type vibrator as at 808 in FIG. 8, vibrating the filling and the aggregate themselves, or transmitting vibrations from the exterior vibrator to the anchoring device via the additional tubular rods may be applied to provide a similar compacting effect.

From the foregoing descriptions, it will also be understood that complete opening of the cutting arms 127 or 227 of the anchoring device is critical to rigidness and reliability in settlement of the anchoring device. The complete opening of the cutting arms 127 or 227 of the anchoring device in the bottom of the shaft assures complete catching in the soil or the filling by the cutting arms.

Figure 11:
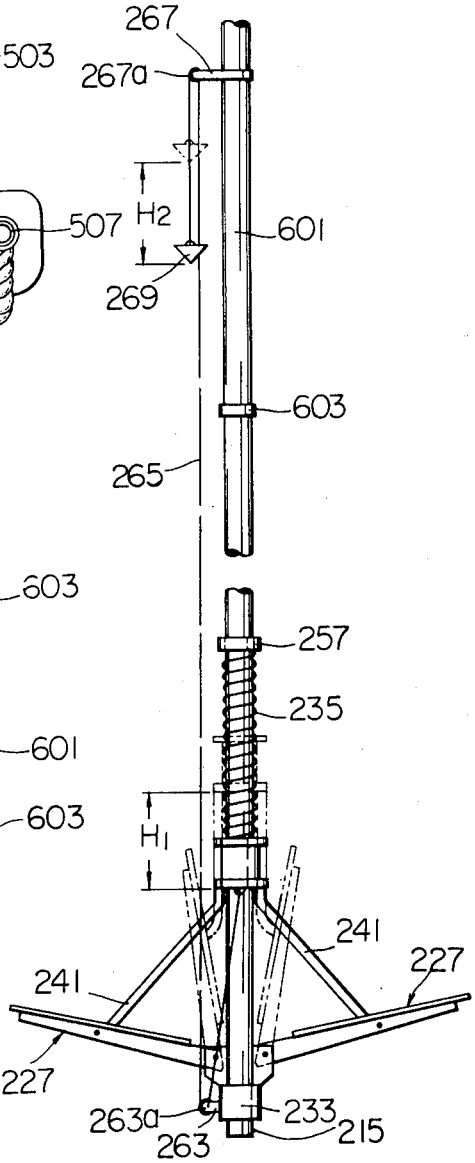
FIG. 11 is a front view of the anchoring device with a means for ascertaining the complete opening of the cutting arms of the device, according to the present invention.

FIG. 11 shows a preferred embodiment of an anchoring device provided with a detecting means to detect from the ground surface level how many degrees the cutting arms are open from the closed or folded state in the bottom of the shaft.

Referring to the anchoring device of FIG. 11 while comparing it with those of FIG. 3A and FIG. 3B, it will be seen that a detecting line 265 consisting of flexible but less elastic material, such as a steel wire, runs along the rods 215 and 601. One end of the detecting line 265 is attached to the lower flange of the annular flange member 251 via a roller 263a rotatably mounted on an attachment 263 of the bottom support 233. The other end of the detecting line 265 is connected to a free weight 269 via a roller 267*a* rotatably mounted on an attachment 267 which is fixed at an appropriate position on the additional rod 601 located above the ground. The detecting line 265, which runs along the rods 601 without slack due to provision of the weight 269, may be guided by suitable guide members provided on the rods 601 so that the detecting line 265 is in parallel with the axes of the tubular rods 215 and 601. Now, assuming that the cutting arms 227 are put in the folded state, as shown by phantom lines in FIG. 11, the annular flange member 251 and also, the weight 269 would be located at positions shown again by phantom lines. Then, while the cutting arms 227 are opening due to the spring force of the spring 235, extension of the spring 235 causes a downward movement of the annular flange member 251 and accordingly, a drop of the weight 269 through the detecting line 265. That is to say, complete extension $H_1$ of the spring 235, which produces the complete opening of the cutting arms 227, can be detected by measuring the height of drop $H_2$ of the weight 269. Since the extension of the spring 235 is always proportional to the opening angles of the cutting arms 227, detection of the height of drop of the weight 269 permits detection of the opening angles of the cutting arm 227 of the anchoring device. Of course, the relationship between extension of the spring 235 and height of drop of the weight 269 should be calibrated before insertion of the anchoring device into the shaft.

In the embodiment of FIG. 11, the lower end of the line 265 is attached to the flange member 251 via the roller 263*a*. However, the same effect may be provided by directly attaching the end to a suitable position of one of cutting arms 227 and, as a result, the anchoring device of the type as shown in FIGS. 1 and 2 may also be provided with such type of detecting means. This provision of the detecting means permits not only detection of the complete opening of the cutting arms, but also can indicate when the pressure water should be supplied during forming the cavity 807 (refer to FIG. 8), since a slow drop of the weight 269 may be an indication of difficulty in forming of the cavity 807 by rotation of the anchoring device alone.

In order to easily detect the height of drop of the weight, sealing may be provided on the outer surface of the tubular rods 601 or on the detecting line itself.

Figure 12:
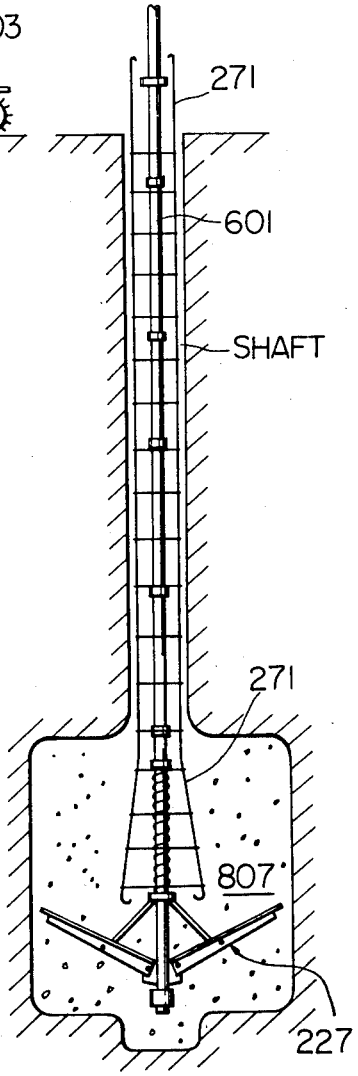
FIG. 12 is a diagrammatical view of the anchoring device, which is completely settled in the ground, according to the present invention.

Referring finally to FIG. 12, a cylindrical cage 271 made of steel rods is inserted so as to surround the tubular rods of the anchoring device. When the cage 271 is permanently settled, by means of the filling, in the shaft together with the anchoring device, the anchoring device may be used as a compression-proof pile in the construction industry. This is true since the arrangement of the cage 271 prevents the filling deforming due to a force transmitted from the rods 601 of the anchoring device and, thus, when the anchoring device together with the cage 271 is used as a pile, a stronger resistance to a compression applied from above the ground can be provided. That is to say, the cage 271 serves as a core for supporting concrete within the shaft and the cavity.

The present invention has been explained with several preferred embodiments. However, many changes and modificatin could be made in the disclosed embodiments without departing from the scope of the present invention.

What is claimed is:

1. A method for settling an anchoring device in a shaft based in the ground, said anchoring device comprising:

a vertical tubular rod; a plurality of support arms, one end of each support arm being connected with a lower part of the tubular rod so that said support arm is turnable about the connected end in a vertical plane including an axis of said tubular rod; a plurality of fluke blades one of which is mounted on each support arm, to constitute cutting arms; means for urging said cutting arms to outwardly turn about said connected ends of said support arms from a folded state in which said cutting arms are brought together about said tubular rods; means for stationarily supporting one end of said urging means on a part of said tubular rod; holding means for releasably restraining said cutting arms in the folded state, said holding means having a line means to release the restraint of said cutting arms above the ground surface, and; means for limiting the turn of said cutting arms to a selected angle from said folded state;

said shaft having a smaller diameter than the distance defined by said cutting arms when opened to said selected angle;

said method comprising at least the processes of:

folding the cutting arms by means of the holding means having the release line;

pulling said release line of said holding means when said anchoring device reaches a bottom of said shaft;

providing rotational motion to said cutting arms lying against the inner wall of said shaft from above the ground by means of an ordinary boring machine for a predetermined time; and lifting said anchoring device while said cutting arms rotate at a preselected height so that a cavity engageable with said cutting arms of said anchoring device is formed in said bottom of said shaft.

2. The method as claimed in claim 1, further comprising a process of supplying pressured water from above the ground through the vertical passageway in the elongated tubular rod and in the vertical tubular rod of said anchoring device so that said pressured water jets from the lowermost part of said vertical tubular rod against said wall of said shaft while said cutting arms rotate.

3. The method as claimed in claim 2, wherein said supply of pressured water is carried out when it is detected by means of the detecting line that said cutting arms are in the process of said outwardly turning motion.

4. The method as claimed in claim 1, further comprising the processes of:

filling said cavity and said shaft with a filling until the filling comes up to the entrance of said shaft and;

subsequently, supplying aggregate material into said filling until said cutting arms are prevented from rotation due to generation of a mixture of said filling and said aggregate.

5. The method as claimed in claim 4, further comprising a process of providing vibration to said anchoring device by means of a vibrator so that compaction of said mixture is produced in said cavity and said shaft.

6. The method as claimed in claim 4, further comprising a process of providing vibration to said mixture of said filling and said aggregate by means of a vibrator so that compaction of said mixture is produced in said cavity and said shaft.

7. The method as claimed in claim 4, wherein said filling of said filling material is carried out after the process of inserting a cage member into said cavity and said shaft which surrounds said anchoring device while keeping distances from the wall of said shaft and anchoring device.

* * * * *

UNITED STATES PATENT AND TRADEMARK OFFICE

CERTIFICATE OF CORRECTION

PATENT NO. : 4,015,433

DATED : April 5, 1977

INVENTOR(S) : Mitsuo Shibata

It is certified that error appears in the above-identified patent and that said Letters Patent are hereby corrected as shown below:

Column 7, line 46, "sealing" should be --scaling--.

Signed and Sealed this

Fourteenth Day of June 1977

[SEAL]

*Attest:*

RUTH C. MASON
*Attesting Officer*

C. MARSHALL DANN
*Commissioner of Patents and Trademarks*